United States Patent [19]

Iwao et al.

[11] Patent Number: 4,912,593

[45] Date of Patent: Mar. 27, 1990

[54] ELECTRICAL APPLIANCE

[75] Inventors: Akira Iwao, Kitaibaraki; Yasuyuki Hiruta; Yoshitaro Ishii, both of Hitachi, all of Japan

[73] Assignee: Hitachi, Ltd., Tokyo, Japan

[21] Appl. No.: 200,832

[22] Filed: Jun. 1, 1988

[30] Foreign Application Priority Data

Jun. 5, 1987 [JP] Japan ..... 62-139804

[51] Int. Cl.[4] ..... H05F 3/02

[52] U.S. Cl. ..... 361/212; 361/220

[58] Field of Search ..... 361/212, 215, 220, 224; 15/339, 377; 174/47

[56] References Cited

U.S. PATENT DOCUMENTS 3,780,345 12/1973 Earman, Jr. ..... 361/220

4,322,777 3/1982 Veta et al. ..... 361/212 X 4,553,191 11/1985 Franks, Jr. et al. ..... 361/212

4,715,085 12/1987 Johanson ..... 361/212 X

OTHER PUBLICATIONS

32

*Primary Examiner*—L. T. Hix

*Assistant Examiner*—Brian W. Brown

*Attorney, Agent, or Firm*—Antonelli, Terry & Wands

[57] ABSTRACT

An electrical appliance utilizes felt for causing a corona discharge to allow accumulated static electricity to be discharged, and a conductive member having a grounding effect and constituted by a pressure washer or the like is provided in the vicinity of the felt, at a distance of 4 mm or greater therefrom. The felt is made of acrylonitrile-copper sulfate composite fibers.

4 Claims, 24 Drawing Sheets

ELECTRICAL APPLIANCE

BACKGROUND OF THE INVENTION

The present invention relates to an electrical appliance, and more particularly to an electrical appliance which is provided with corona discharge generating means for removing static electricity.

Generally, when an electrical appliance is used, static electricity is generated to some extent or other in places where friction occurs. To illustrate the case of an electric vacuum cleaner, when the dust is sucked, the dust is sucked through an intake port, passes through an extension pipe and a hose, and enters a dust case. The collision and friction of the dust with internal walls of the extension pipe and the hose take place repeatedly, and static electricity is generated as a result. In addition, when the dust is sucked into the dust case as well, static electricity is similarly generated due to the collision and friction with the inner wall of the dust case.

In cases where the material of the parts where static electricity occurs is a metal, when the operator touches those parts, he receives a large electric shock. This is attributable to the fact that, as compared with cases where static electricity is generated in a plastic material, even if the potentials of static electricity are identical, the metallic material is electrically conductive, so that all the charge accumulated in the metallic material is induced. On the other hand, since the plastic material is basically nonconductive, the induction of the charge does not take place so that an electrical shock is small. For this reason, conventional electrical applicances are provided with the following measures against static electricity:

(1) A wire which is exclusively used for grounding is provided, extending from a portion where static electricity is generated to the ground to constantly remove electrostatic electricity.

(2) An arrangement is provided such that the operator is constantly kept in contact with a portion where static electricity is generated to remove static electricity through the human body, or the potential of the human body is made identical with that of the portion where static electricity is generated to prevent the operator from being subjected to an electrical shock.

(3) A conductive member is suspended from the apparatus to the floor to remove static electricity.

(4) To remove static electricity, a wire is provided from a portion where static electricity is generated to an outer casing such as a housing of an electric blower, i.e., a member which is disposed adjacent to an energized conductive material and sufficiently has the effect of grounding. In this case, a resistor (in which a high resistance value of 15 MΩ or the like is used in an embodiment) is provided in the aforementioned wiring to ensure that a very small amount of current flows even if the insulation level is destroyed due to deterioration of insulation or the like of the electric blower and a short-circuiting occurs as a result.

The above-described prior art solutions to static electricity are fraught with various problems such as those described below.

With reference to the prior art (1) in which a special wire for grounding is provided, extending from the portion where static electricity is generated to the ground, this measure can be adopted relatively easily in the case of an installed (fixed) type. However, in the case of a mobile apparatus such as an electric vacuum cleaner, it is necessary to use a power cord with a grounding wire and to connect the same with the grounding. Athough the provision of such a power cord with a grounding wire is influenced by the power source, there are many cases where the provision is difficult. In addition, there is a possibility that the apparatus is operated without using the grounding, so that there is the problem of safety in addition to the handling efficiency.

In the arrangement of the prior art (2) in which the operator is constantly kept in contact with the portion where static electricity is generated, in a state in which an insulating material such as rubber is laid on the floor, the human body assumes an insulated condition, so that the potential is built up gradually. Hence, there is the possibility of the human body assuming the state of a high potential, with the result that there still remains the problem of safety.

In the arrangement of the prior art (3) in which a conductive member such as a chain is suspended from the apparatus, there is the problem that the grounding effect cannot be obtained if the apparatus is used on an insulating material such as rubber, in which case static electricity cannot be eliminated.

The arrangement of the prior art (4) is a generally adopted means in which an outer casing (such as a housing of an electric blower), i.e., a member which is disposed adjacent to an energized conductive material of the power source and has a sufficent grounding effect, is made conductive with the portion where static electricity is generated. In this arangement, the resistor is inserted to enhance reliability, as mentioned above, so as to ensure that only a very small current will flow if the outer casing of the electric blower is short-circuited due to the dielectric breakdown of the electric blower.

However, if the resistor is further short-circuited with the electric blower also being short-circuited, the status becomes such that a source voltage is directly applied to the dust case, involving the danger of electrification. Although the occurrence of such cases may be practically nil in terms of the probability; however, an element of danger still remains. In foreign countries, 220 V or 240 V is mainly used as the source voltage, which involves a high level of danger as compared with 100 V in the case of Japan. Hence, the adoption of this measure has been a problem in meeting such safety standards as Australiaa's SAA and West German VDE.

As described above, there have been problems in the prior art in terms of the handling features, reliability, safety, meeting the requirements of overseas standards, etc., and there have also been additional drawbacks in terms of productivity and production costs.

SUMMARY OF THE INVENTION

Accordingly, an object of the present invention is to provide an electrical appliance which is capable of positively removing static electricity generated, has a structure which excels in handling efficiency, reliability and safety, and is also capable of meeting safety standards of various countries, thereby overcoming the above-described drawbacks of the prior art.

To this end, in accordance with the present invention, there is provided an electrical applicance comprising corona discharge generating means to remove static electricity generated in the electrical appliance.

The means of causing a corona discharge is constituted by an acrilonitirle-copper sulfate composite fibers.

The diameter of the fiber is extremely small at approximately 15 μm, the thickness of its conductive film is 300–1,000 Å, and its specific resistance is $585\times10^{-1--2}\Omega$.cm, displaying characteristics that are close to those of a semiconductor. Therefore, this material has excellent corona discharge characteristics. Specifically, the aforementioned fibrous material having excellent corona discharge characteristics is made conductive with a portion where static electricity is generated, and a conductive member having a sufficient grounding effect is disposed in the vicinity of the fibrous material, causing a corona discharge to take place between the fibrous material and the conductive member to eliminate static electricity. In addition, an arrangement may be provided such that the aforementioned fibres are provided on an outer casing where static electricity is produced, by means of electrostatic implantation or a similar technique, so as to allow the fibers to undergo a corona discharge directly into the air, thereby eliminating the static electricity of the apparatus.

As described above, the means for causing a corona discharge, which is constituted by fibres which have a very small diameter, a very thin conductive film, and a specific resististance close to that of a semiconductor, facilitates the occurrence of a corona discharge, since the fibres are very fine and have a very thin film, and the electric field is therefore dispersed, its area of contact with the ambient air is large, and a condition conducive to the ionization of the air is created.

A description will be given of the operation of the technical means concerning the elimination of static electricity by taking a vacuum cleaner as an example.

The aforementioned fibrous material which has excellent corona discharge characteristics is placed inside a body case of the vacuum cleaner, and is made conductive with and connected to a dust case which is charged with static electricity.

Meanwhile, a conductive member having its one end disposed on an outer casing of an electric blower is similarly provided inside the body case such as to be located in the vicinity of the fibrous material (at a distance of 4 mm or more in the embodiment).

In the above-described arrangement, static electricity accumulated in the dust case undergoes a corona discharge from the fibrous material to the conductive member, thereby eliminating static electricity.

Since the fibrous material and the conductive member are spaced apart from each other at a distance of 4 mm or more, the apparatus is provided with a structure which excels in electical insulation and voltage withstanding properties, improves the safety and reliability, and meets the safety standards of foreign countries. In another example, the fibers are made to adhere to an outer casing, such as a dust case or an extension pipe, where static electricity accumulates, by means of electrostatic implantation or a similar method, so as to cause the fibers to undergo a corona discharge directly into the air. Thus, a structure which is outstanding in terms of productivity and safety can be provided.

BRIEF DESCRIPTION OF THE DRAWINGS

FIGS. 8 to 12 illustrate a prior art, in which

FIGS. 8 and 9 are top plan views thereof;

FIG. 10 is a diagram illustrating the structure of the grounding;

FIG. 11 is a side elevational view;

FIG. 12 is an enlarged cross-sectional view of essential portions;

DESCRIPTION OF THE PREFERRED EMBODIMENTS

Figure 1:
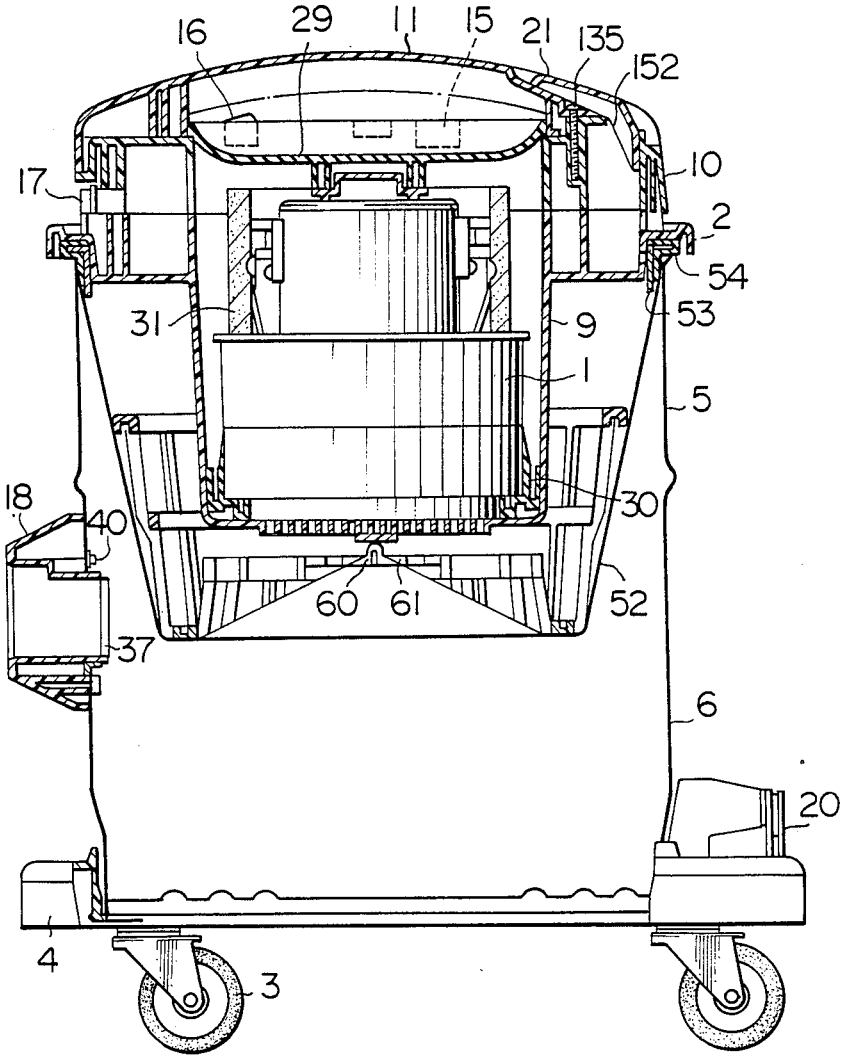
FIG. 1 is a vertical cross-sectional view illustrating an overall arrangement of the body of a vacuum cleaner in accordance with an embodiment of the present invention.

Referring now to the accompanying drawings, a description will be given of a preferred embodiment of the present invention. In the cross-sectional and perspective views of an overall arrangement shown in FIGS. 1 to 4, a vacuum cleaner comprises a body case 2 which incorporates an electric blower 1 as well as a dust case 6 which is constituted by a tank 5 secured to a castor base 4 on which castors 3 are provided.

The body case 2 comprises a motor base 9 for accommodating the electric blower 1 as well as an upper case 10. As illustrated in the drawings, the following components are provided on these components: a handle 11, a blower 12; an indicator 13 for indicating an amount of dust collected; a body socket 15 to which a power cord 14 can be detachably connected; a power switch 16; and a power brush socket outlet 17 which is used as a power supply for an nozzle with an electric rotary brush (not shown) attached to the outside of the apparatus.

An intake port member 18, into which a hose is detachably inserted, is provided on a side surface of the tank 5 by means of a screw 40, mouth packing 37 being provided at the rear end of the intake port member 18 such as to be disposed on an inner side of the tank 5. A clamp 19 is provided on an opposite side surface of the tank 5 by means of a pad 35 and screws 36.

Figure 21:
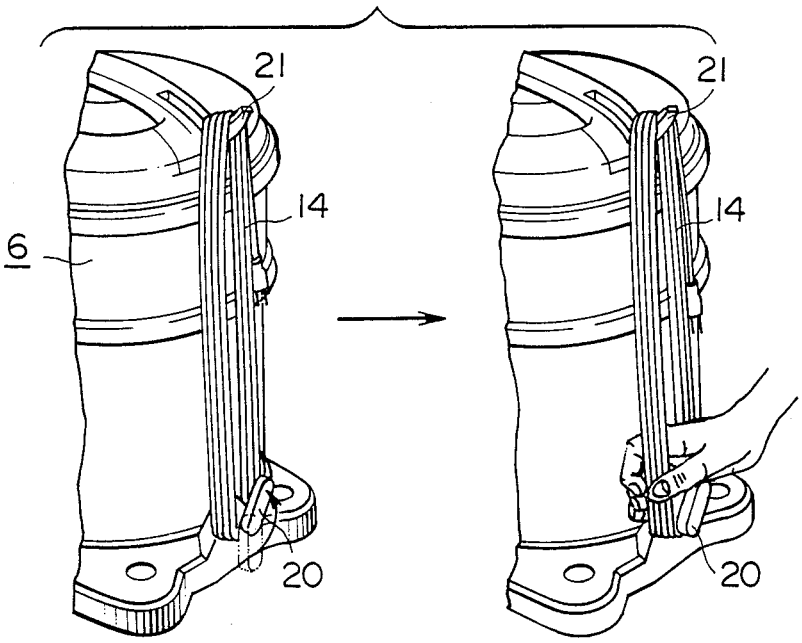
Figure 22:
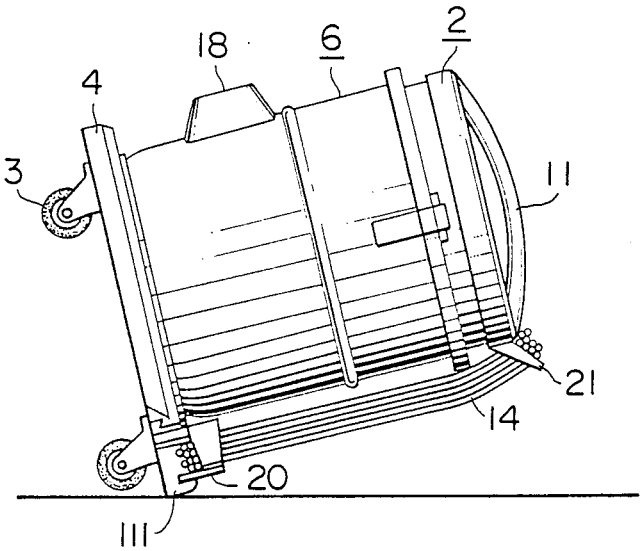
FIGS. 22 and 23 are diagrams illustrating the protection of a lower cord hook and an auxiliary intake port during accommodation of parts.

A lower cord hook 20 provided on the castor base 4 and an upper cord hook 21 rotatably supported by a handle 11 are provided in a rear portion of the vacuum cleaner in such a manner as to face each other vertically. These cord hooks 20, 21 are so arranged that the power cord 14 can be wound therearound, as shown in FIG. 21. A plurality of parts accommodating holes 22 are provided on an upper outer periphery of the castor base 4 and are capable of detachably supporting a nozzle 23 for tight spaces and a brush 24 for shelves by allowing them to be inserted and fitted therein. The indicator 13 is accommodated in a recess 56 of the upper case 10 and is covered with an indicator cover 25.

Figure 4:
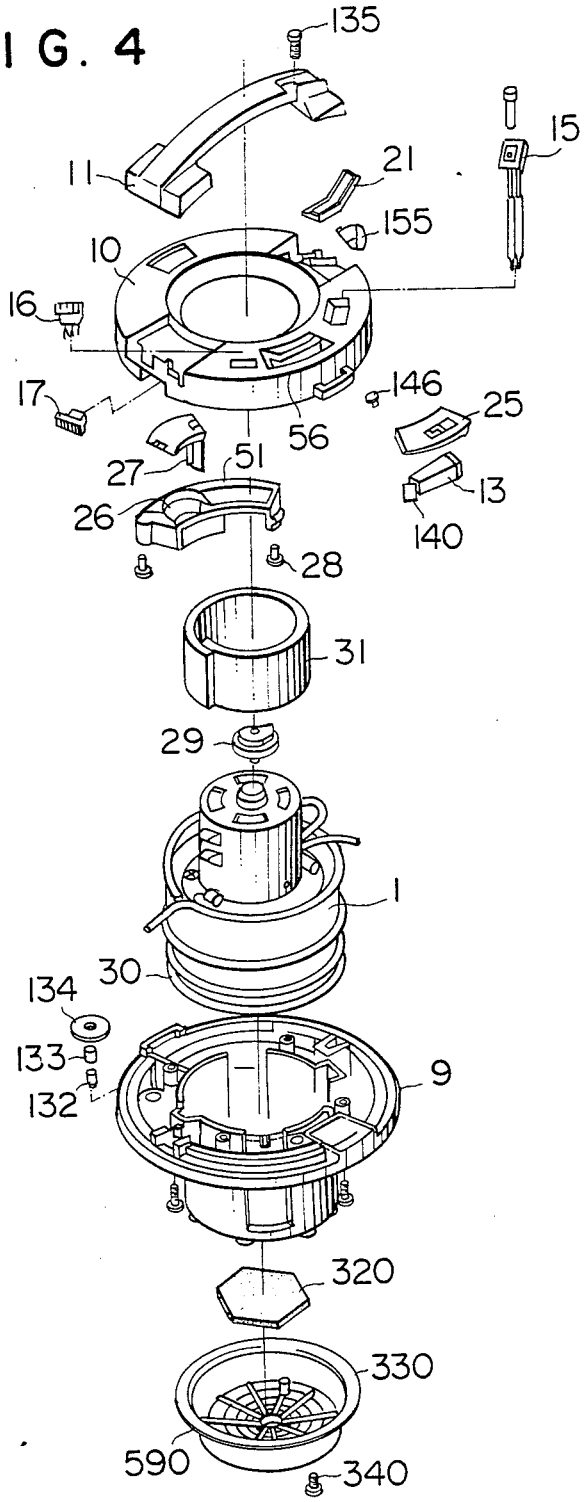
FIG. 4 is an exploded perspective view of a body case.
Figure 5:
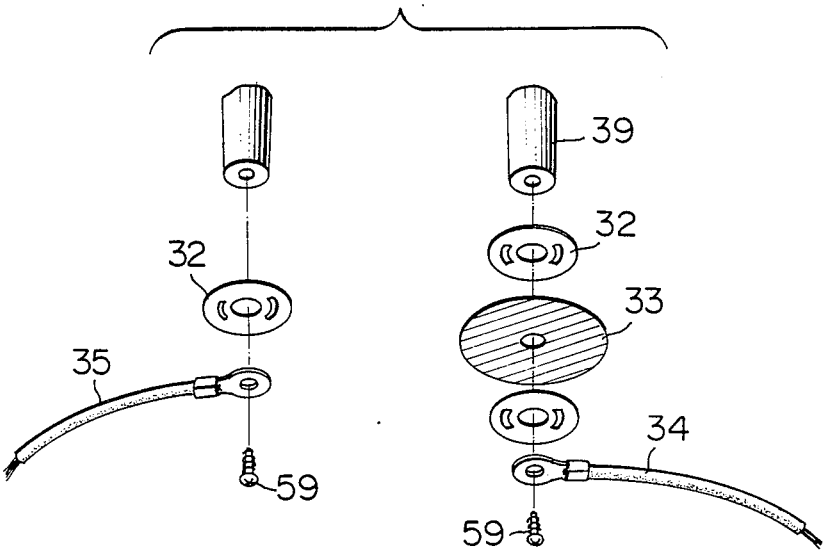
FIG. 5 is a exploded perspective view of essential portions.
Figure 35:
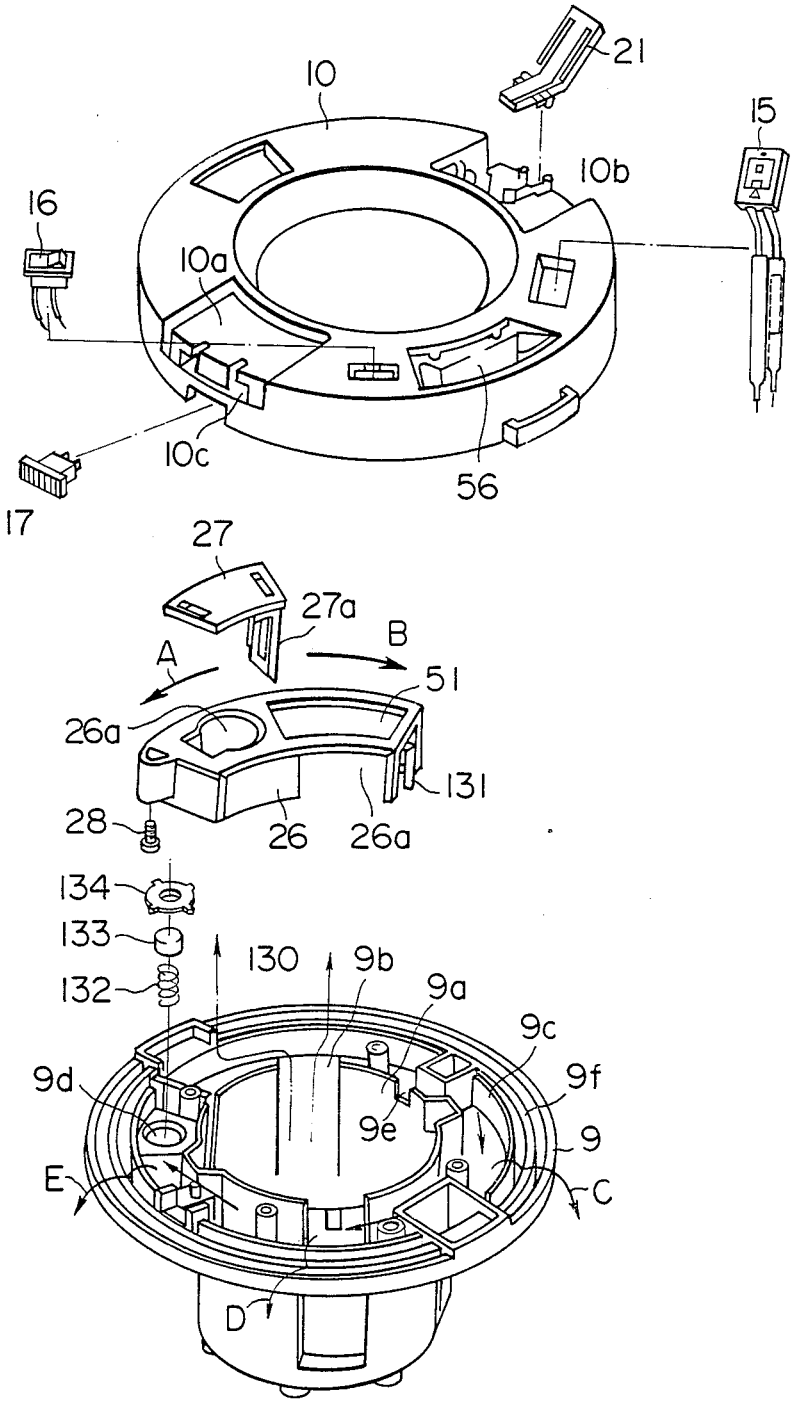
FIG. 35 is a diagram of an arrangement of an upper case installing parts and an exhaust air passage.
Figure 36:
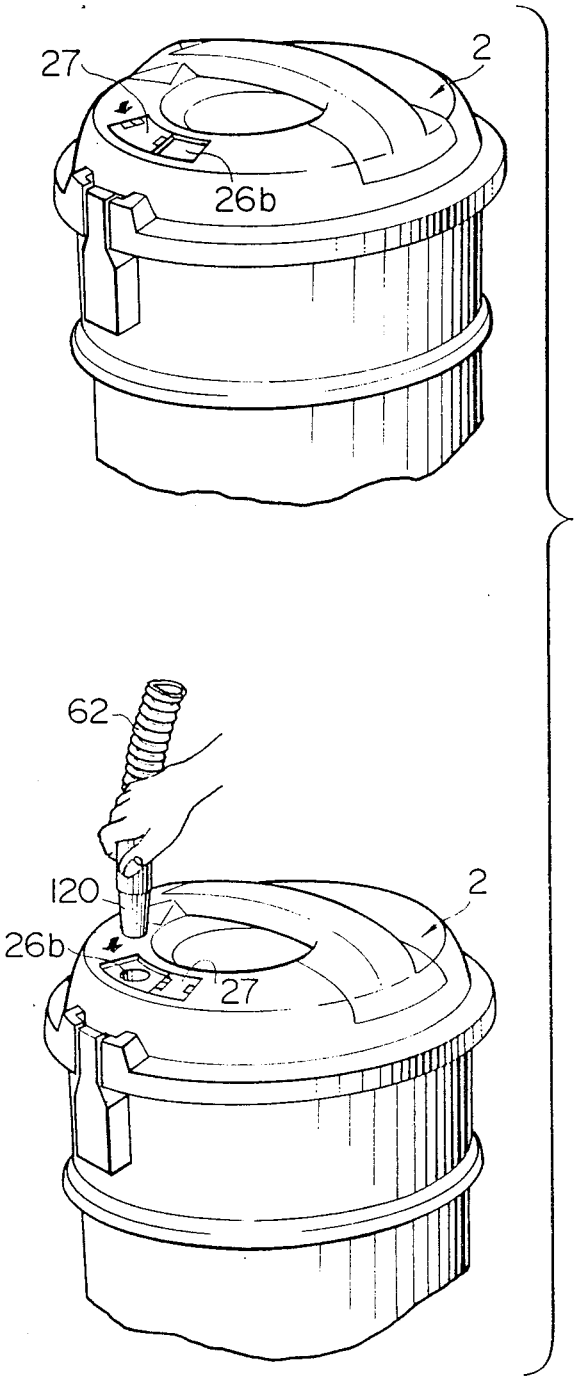
FIG. 36 is a schematic diagram concerning a blower.

The arrangement of the blower 12 is shown in FIGS. 4 and 35. Specifically, the blower 12 comprises a blower cover 27 which fits in a fan-shaped hole portion 51 of a blower body 26 such as to be slidable. The blower 12 is secured to the upper case 10 by a screw 28. As shown in FIG. 36, a flow passage having the function of a blower by employing a centralized exhaust system as well as a flow passage for exhausting from an outer periphery of the upper case 10 in a decentralized manner are formed by a combination of the upper case 10 and a partition wall of the motor base 9. The flow passages are adapted to be changed over as the blower cover 27 is opened and closed. The details of the arrangement of the blower 12 will be described later. The electric blower 1 is supported between the motor base 9 and the upper case 10 via vibration-proof rubber 29, 30 in such a manner as to be vibration-proof. A noise absorption cover 31 is provided around an outer periphery of the electric blower 1. An air-permeable protective filter 320 for covering an air suction hole 58 on the bottom of the motor base 9 is installed on the motor base 9 with a screw 340 by means of a protective filter support 330 having a ventilating hole 590 which is constituted by a radial lattice. Particularly when the vacuum cleaner is used in a place which needs to be kept hygienic, such as a hospital, extremely hygienic exhaust can be performed since the protective filter 320 can be installed. A cloth filter 52 comprises a filter frame 53 and a filter cage 54. The material of the filter is not restricted to cloth, and another filtering material, such as a nonwoven fabric or a rigid filter paper, may be used. The filter cage 54 is arranged such that an engaging projection 60 provided in the cloth filter 52 is fitted with a central hole 61 provided on the filter cage 54, and the filter cage 54 is thus partly connected to the cloth filter 52. An arrangement for causing a corona discharge to take place in accordance with this embodiment is arranged as follows: As shown on the right-hand side in FIG. 5, felt of acrylonitrile-copper sulfate composite fibers (the diameter of the fiber is extremely small at approximately 15 μm, the thickness of its conductive film is 300–1,000 Å, and the specific resistance is $585\times10^{-1--2}\,\Omega$.cm and is close to that of a semiconductor) is placed between a pair of pressure washers 32. One terminal of a lead wire sub-assembly 34 is placed thereon, and these components are installed on a rib 39 provided on the upper case 10, by means of a screw 59. The other terminal of the lead wire sub-assembly 34 is soldered to a contact 146 secured to the upper case 10. Meanwhile, a combination of one pressure washer 32 and one terminal of a lead wire sub-assembly 35 are installed onto another rib 39 by means of another screw 59 in such a manner as to oppose the assembly in which the felt 33 is installed, while the other terminal of the lead wire sub-assembly 35 is secured to a frame or the like of the electric blower 1. With the two assemblies installed by means of the screws 59, the distance l between the felt 33 and the opposing washer 32 is kept at approximately 4 mm or more.

Figure 37:
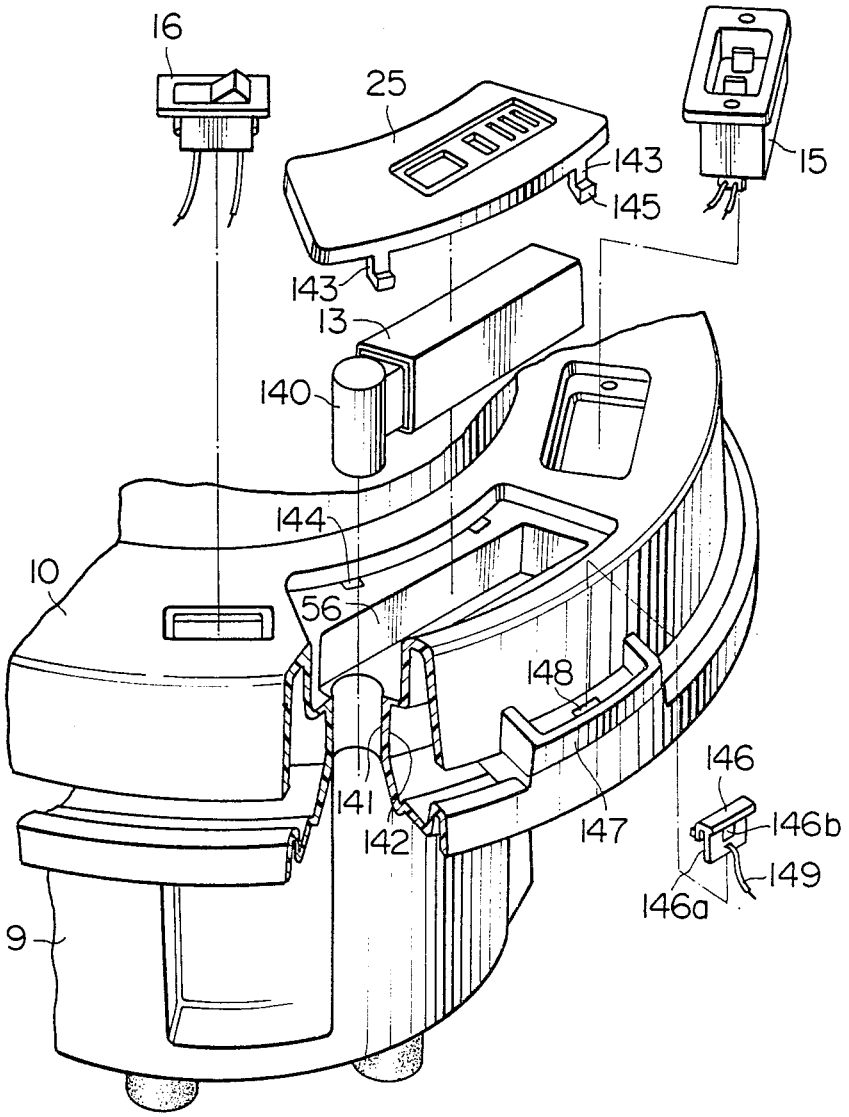
FIG. 37 is a schematic diagram illustrating an indicator installing portion and a grounding contact both provided on the body case.
Figure 38:
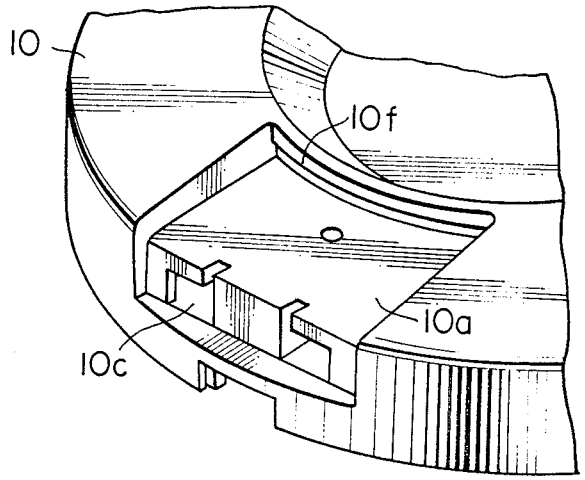
FIG. 38 is a perspective view illustrating a handle installing portion on the front of the upper case.
Figure 39:
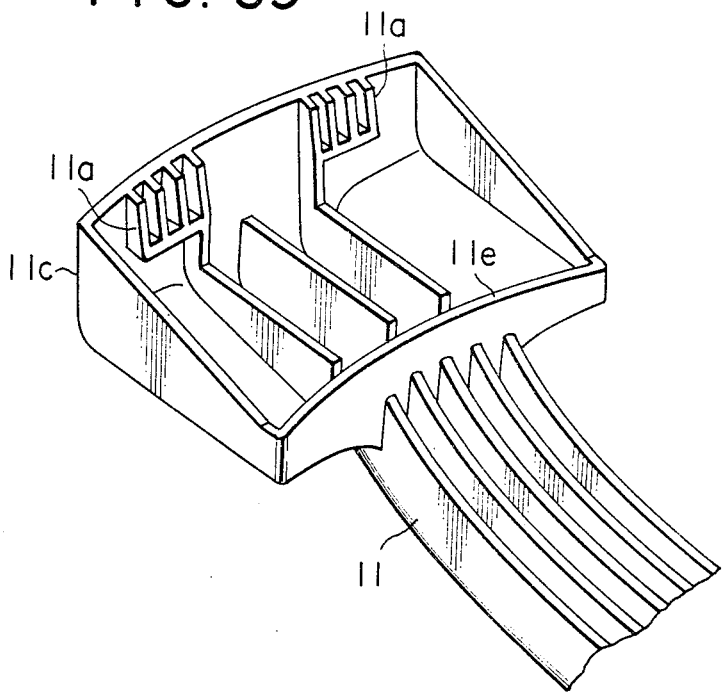
FIG. 39 is a perspective view illustrating a latch provided on the front of a handle.
Figure 41:
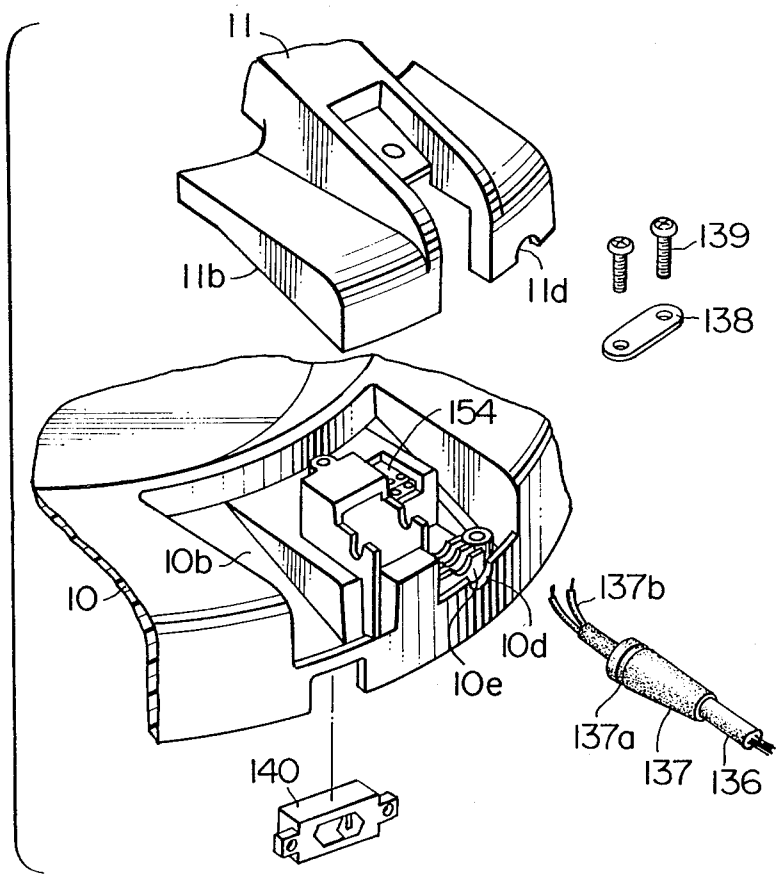
FIG. 41 is a diagram illustrating the positions of installation of a handle installation portion, a directly connected power cord in accordance with another embodiment of the present invention, and a power changeover switch, all of which are provided on a rear portion of the upper case.
Figure 40:
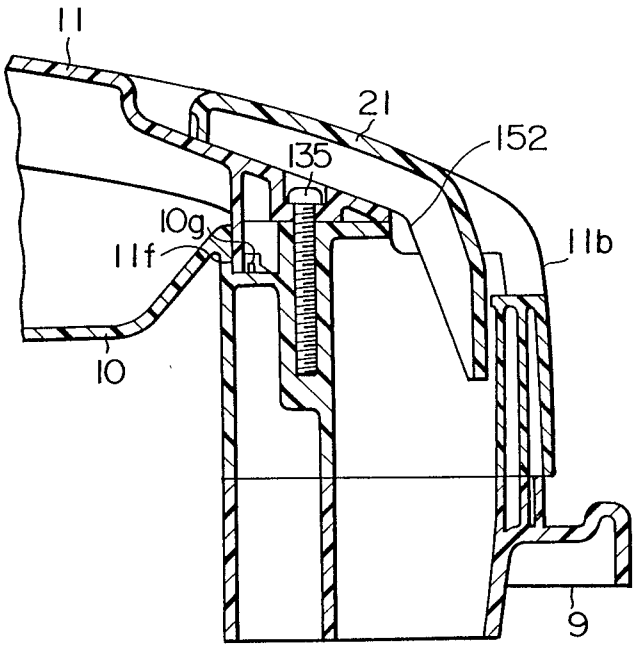
FIG. 40 is a cross-sectional view illustrating the state of installation of the handle and an upper cord hook on the upper case.

The aforementioned contact 146 is formed of a resilient conductive material such as phosphor bronze, and is arranged such that, as shown in FIG. 37, a tongue portion 146*a* thereof is inserted into a slit 148 provided in a clamp engaging portion 147 integrally provided in the upper case, and a cut-out 146*b* provided in the tongue portion 146*a* serves as a stopper.

A lead wire 149 is connected to this contact 146, and, as the clamp 19 is engaged, a circuit is thereby formed for allowing static electricity to escape from the tank 5 via the clamp 19, the contact 146, and the lead wire 149 to the frame or the like of the electric blower 1 to which the other terminal of the lead wire 149 is connected and has a large electrostatic capacity.

As the clamp 19 is simply engaged, an electrostatic charge preventing circuit can be automatically formed.

In addition, the contact 146 can be secured by being inserted into the hole 148 without using any special securng part such as a screw or rivet, so that the work efficiency and economic efficiency can be impoved appreciably.

Hereafter, a detailed description will be given of the operation of each part.

Figure 8:
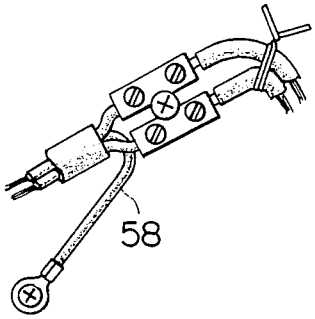
FIG. 8 PRIOR ART
Figure 9:
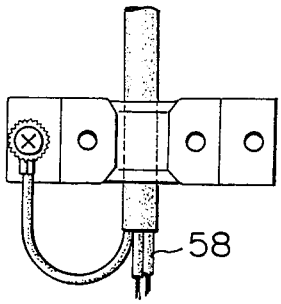
FIG. 9 PRIOR ART
Figure 10:
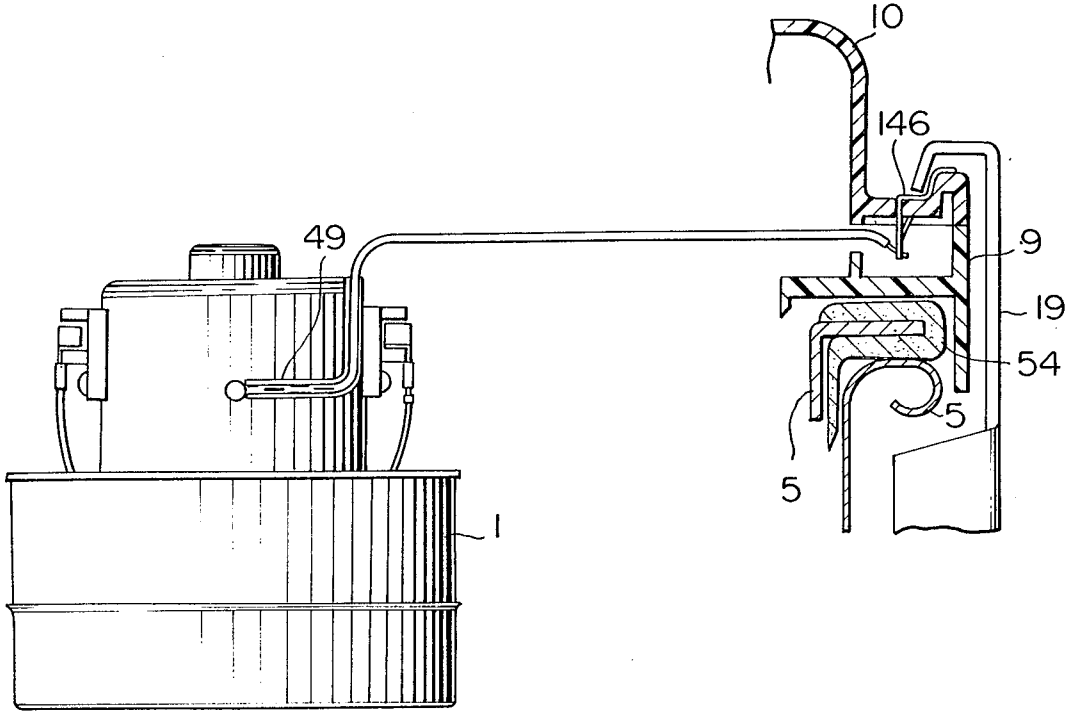
FIG. 10 PRIOR ART
Figure 11:
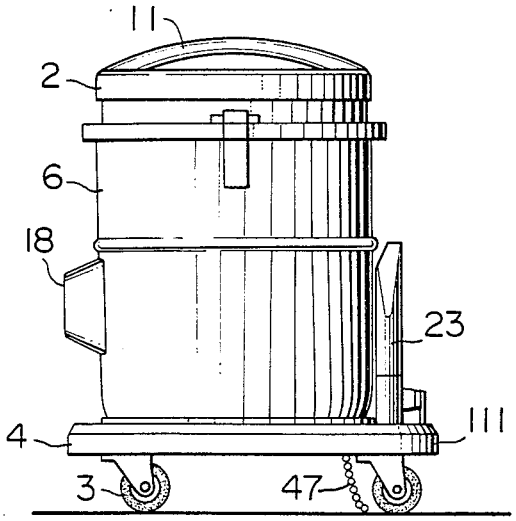
FIG. 11 PRIOR ART
Figure 12:
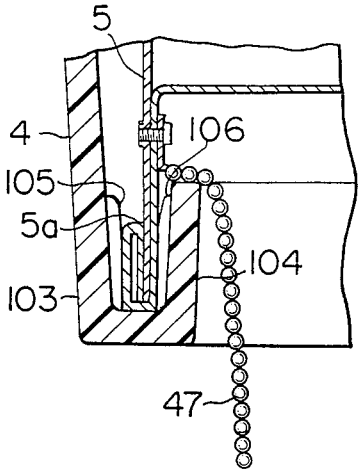
FIG. 12 PRIOR ART

FIGS. 8 to 12 show examples of the prior art. Each example illustrates a method of removing static electricity generated in a vacuum cleaner. Conventionally, the following measures have been taken as measures for allowing static electricity to escape: one in which, as shown in FIGS. 8 and 9, a three-core power cord 58 with a grounding core is used as a power cord, and the grounding core is installed on a part of the body; another in which, as shown in FIG. 10, a clamp 19 is brought into contact with a contact 146, and a lead wire is connected between the contact 146 and the electric blower 1 (a resistance 49 of 15 MΩ or thereabout with a high level of insulation properties is used as the lead wire); and another in which, as illustrated in FIGS. 11 and 12, a metallic chain 47 is provided from the metallic portion of the main body to the ground so as to allow static electricity generated to escape. However, in the case of the measures shown in FIGS. 8 and 9 among the above-described measures, there are cases where the vacuum cleaner cannot be used as an export item since it fails to conform with standards of a foreign country due to the problem of an insulating structure and the like of the main body. In addition, in the case of the measure shown in FIG. 11, static electricity does not always escape since the grounding earth varies in accordance with the place of use, so that when the earth is adjacent to a nonconductive material, static electricity does not escape from the body, entailing a danger when the operator touches the body. The present invention is capable of solving all the above-described problems.

Figure 6:
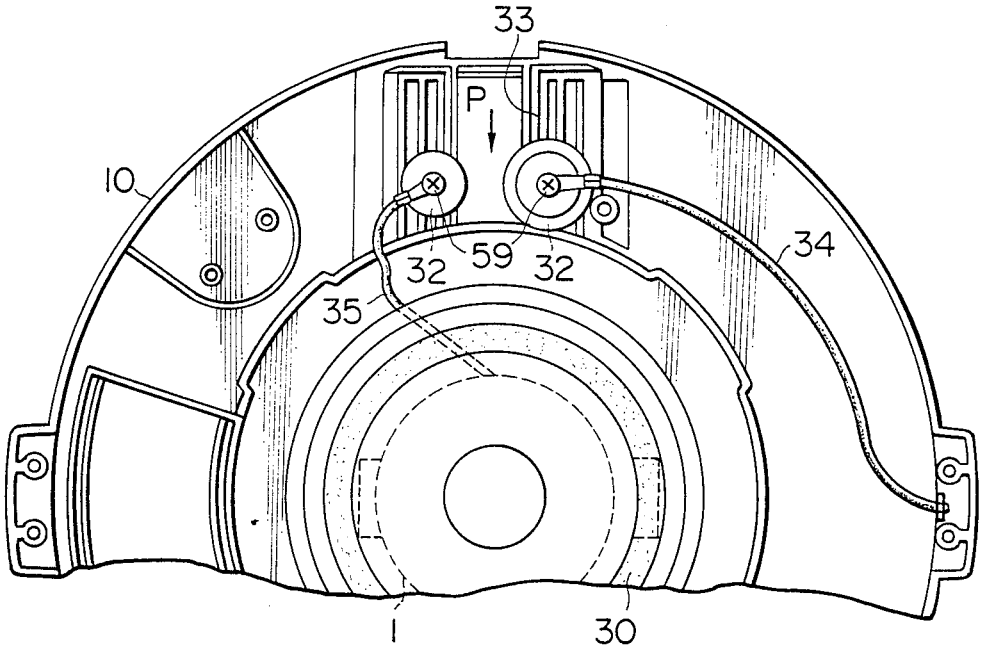
FIG. 6 is a top plan view of essential portions.
Figure 7:
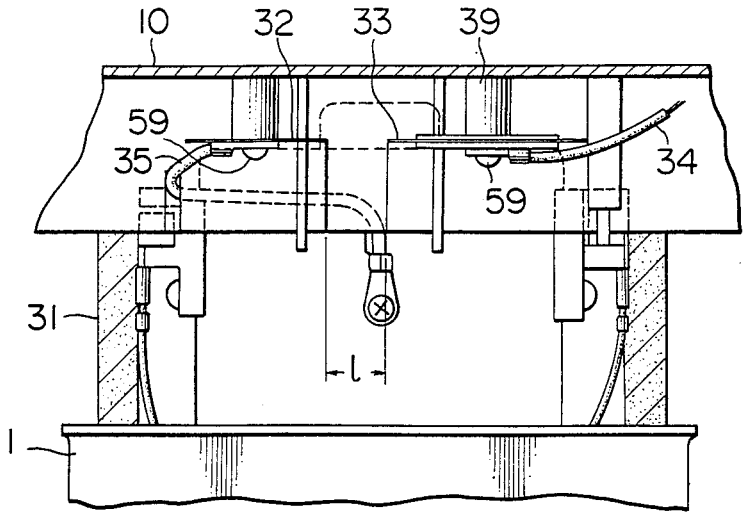
FIG. 7 is an elevational view taken in the direction of the arrow P in FIG. 6.

In FIGS. 6 and 7, since the contact 146 secured to the upper case 10 is soldered to one terminal of the lead wire sub-assembly (A) 34, static electricity which is generated in the tank moves from the clamp 19 to the felt 33 via the contact 146, and the lead wire sub-assembly (A) 34. At that time, since the felt 33 is formed of acrylonitrile-phosphor bronze composite fibers and has excellent corona discharge properties, a charge having a polarity opposite to that of static electricity is induced in the felt 33. Consequently, a strong electric field is generated, the ambient air is hence ionized, and the charge of static electricity is neutralized by movement of positive ions in the felt 33, thereby allowing static electricity to be released. However, since static electricity generated in the body cannot be removed by the effect of corona discharge properties of the felt 33 alone, the conductive pressure washer 32 is provided such as to face the felt 33 (the distance l between the felt 33 and the pressure washer 32 being approximately 4 mm or more). Although the felt 33 has a high level of charge, the opposing pressure washer 32 has no charge. Hence, if a high level of charge is applied to one, while a low level of charge is applied to the other, insulation of air between the felt 33 and the pressure washer 32 is broken, which in turn enables a corona discharge to take place and to release the charge accumulated in the felt 33 to the pressure washer 32 and, in the end, to escape to the electric blower 1 via the lead wire sub-assembly 35.

As has been described above, since a structure is adopted for producing a corona discharge, it is possible to eliminate static electricity. In terms of the structure, insofar as the metallic parts are spaced apart from each other up to the distance prescribed by the standards or the like of a vacuum cleaner, any structure may be adopted. If the distance is increased, the effect of removal of static electricity becomes slightly weaker, but the area of the felt may be increased depending on the situation.

Figure 13:
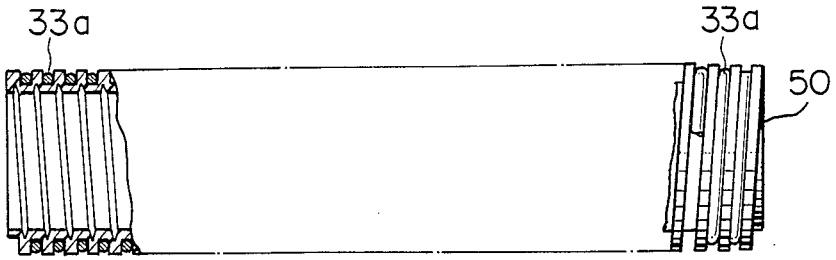
FIG. 13 is an enlarged top plan view.

In addition, as shown in FIG. 13, if the felt **33*a*** is formed into the shape of a cord and is wound around the hose, static electricity or the like having a small level of charge and accumulated in the hose can be removed simply.

Figure 14:
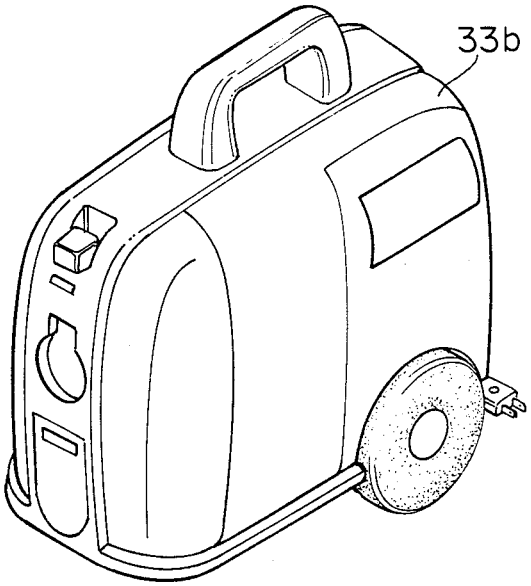
FIG. 14 is an overall perspective view.

FIG. 14 shows the vacuum cleaner in which the felt **33*b*** is provided with coloring and is adhered to the surface of the body, which gives a favorable impression to the user in terms of design, and since the felt for removing static electricity is provided on the overall body, an outstanding effect can be obtained in removing static electricity.

Figure 15:
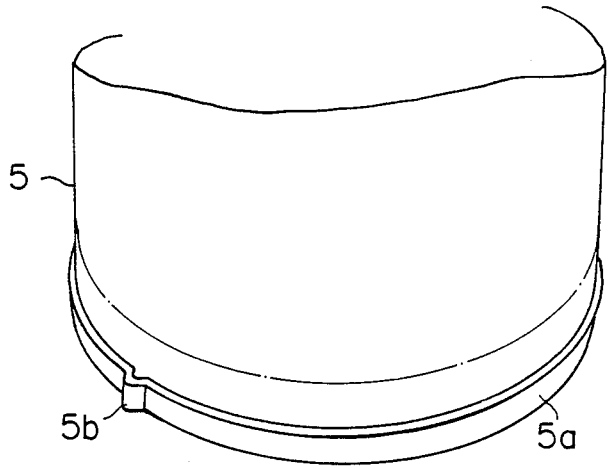
FIG. 15 is a perspective view of essential portions illustrating a lower portion of a tank.

As for a method of installing the tank 5 onto the castor base 4, as shown in FIGS. 15 to 19, securing is effected by means of a fitting force obtained by a curled portion **5*a* at the bottom of the tank 5 as well as internal and outer peripheral portions of an annular rib 103 and an annular rib 104 on the side of a castor base 4. The tank 5 is formed into the shape of a drum and is fabricated from a cylindrical side plate such as a steel plate and a disk-shaped bottom plate by means of a winding and tightening method. The curled portion 5*a* is provided with a projection 5*b* in a part thereof, as shown in FIG. 15**.

Figure 16:
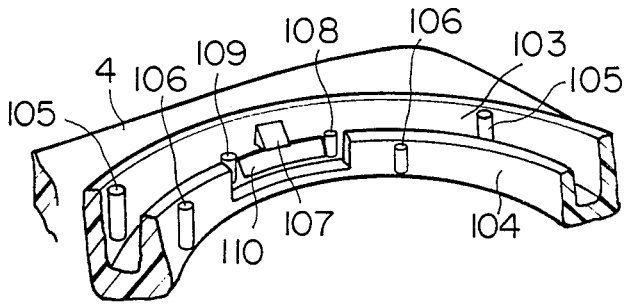
FIG. 16 is a perspective view illustrating a tank fitting portion of a castor base.

The castor base 4 is formed of a plastic, and a plurality of projections are provided alternately on the inner and outer peripheries of the annular ribs 103, 104, as shown in FIG. 16.

Figure 17:
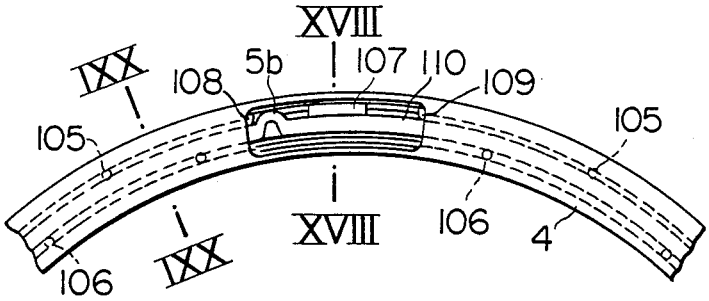
FIGS. 17, 18 and 19 are diagrams illustrating the state of fitting of the castor base and the tank.
Figure 18:
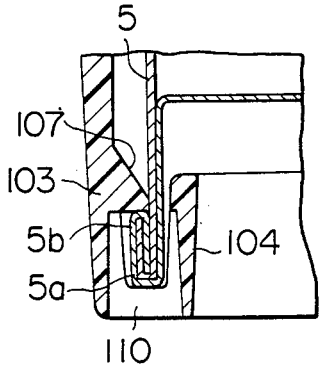

Projections 107 each having a triangular-shaped cross section whose apex is located at the top of the cross section are provided at a plurality of locations around the inner periphery of the annular rib 103, and a pair of projections 108, 109 are respectively provided at opposite ends thereof. Numeral 110 denotes a hole which is formed due to the structure of a mold for forming the projection 107. In the above-described arrangement, after the projection **5*b* of the tank 5 is positioned such as to be placed between the projection 108 and the projection 107 or between the projection 109 and the projection 107, the tank 5 is pressed into the castor base 4 in such a manner that the curled portion 5*a* is fitted by overriding the projection 107, as shown in FIGS. 18 and 19, which are respectively cross-sectional views taken along the lines P-Q and X-Y of FIG. 17**, thereby completing the coupling.

The curled portion **5*a* is prevented from being pulled off upwardly by virtue of engagement with the projections 107**.

Figure 19:
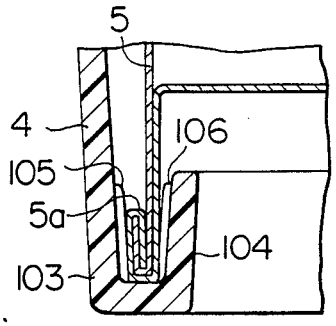

As for the means of fixing the tank 5 to the tank base 4 in the rotating (circumferential) direction, as shown in FIG. 19, the projections 105 and 106 are so arranged to clamp the curled portion **5*a* alternately from the inner and outer peripheries thereof, and the tank 5 and the castor base 4 are secured to each other by means of the resiliency of a plastic. Furthermore, as for the prevention of rotation caused by a large rotating force, as shown in FIGS. 17 and 18, the projection 5*b* of the curled portion 5 abuts against the projection 108 or 109**, thereby preventing any further rotation.

Thus, the tank 5 can be coupled with and secured to the castor base 4 by the simple operation of pressing the tank 5 into the castor base 4.

The tank 5 and the castor base 4 can be secured to each other to oppose not only a pulling-out force but also a rotating force, so that the relative positions of the tank 5 and the castor base 4 in the rotating direction are not offset.

As for the adjustment of the fitting force, fitting is effected not at the entire peripheries of the annular ribs, but the curled portion 5a of the tank 5 is clamped by the alternately arranged projections 105, 106. Consequently, adjustment of the fitting force is possble by simply adjusting the height of each projection during fabrication of the mold, so that the operation can be extremely simplified. Even if slight variations occur in the dimensions of the tank base 4 and the curled portion 5a of the tank 5 which are plastic moldings, since the the curled portion 5a is clamped at a plurality of points, the tightening force obtained by the resiliency of the annular ribs 103, 104 does not change substantially, and a stable fixing force can be obtained.

Thus, it is possible to install and secure the tank to the castor base 4 in a simple operation, thereby remarkably improving the productivity.

Figure 20:
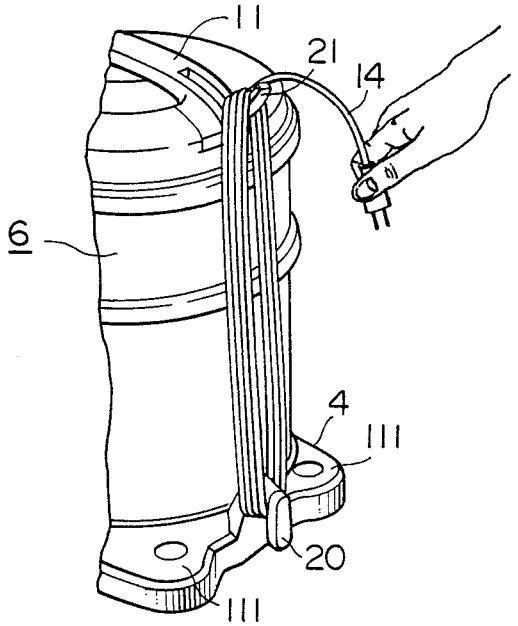
FIGS. 20 and 21 are diagrams illustrating a method of accommodating a power cord and releasing the same.

As described above, the power cord 14 can be wound around the lower cord hook 20 and the upper cord hook 21 so as to be accommodated, as shown in FIG. 20. To take out this power cord 14, if the lower cord hook 20 rotatively supported by the castor base 4 is rotated 180°, as shown in FIG. 21, and the lower portion of the bundle of the power cord 14 is then held with the hand and pulled out, the power cord 14 can be taken out at one one.

The castor base 4 is configured such that left- and right-hand portions (rearward projections) 111 thereof partly surrounding the lower cord hook 20 project rearwardly. This arrangement provides the following advantage.

When the cleaner body is overturned rearwardly, since the rearmost end of the lower cord hook 20 is disposed inwardly of the rearward projections 111 of the castor base 111, the lower cord hook 20 is always protected by the castor base 4 regardless of whether or not the power cord 4 is accommodated.

Figure 23:
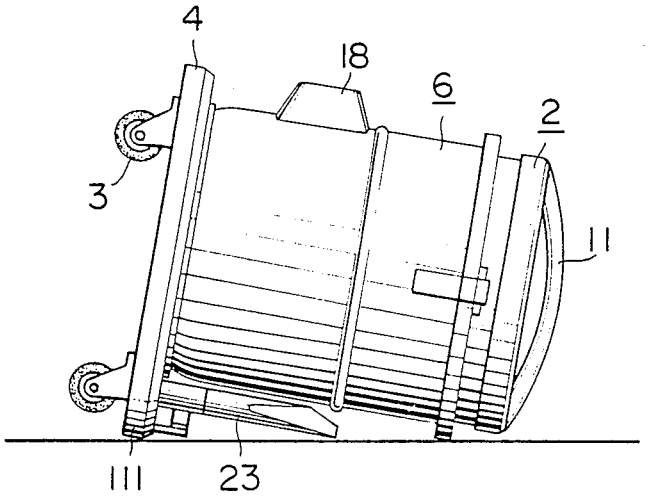
Figure 24:
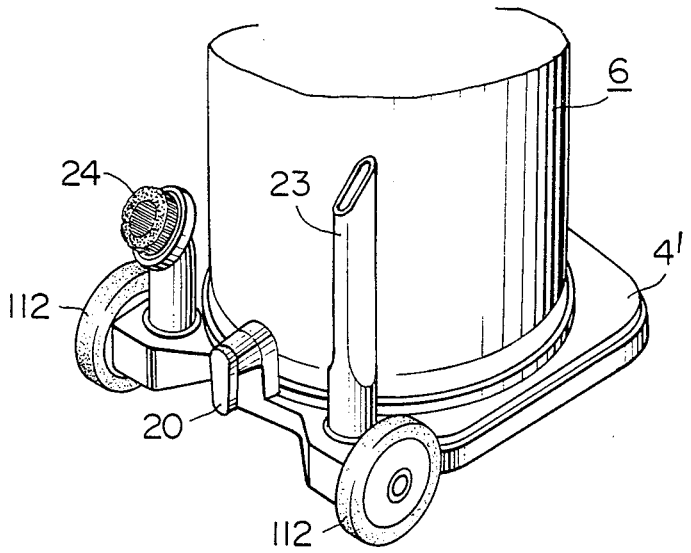
FIG. 24 is a perspective view illustrating another example concerning the protection of the lower cord hook and the auxiliary intake port.

Also, as shown in FIG. 23, this arrangement makes it possible to prevent such application parts as the nozzle for tight paces installed in parts accommodating holes 22 from colliding directly against the floor surface. An effect similar to that described above can be obtained if, instead of the rearward projections 111, fixed castors 112 are made to project up to the rearmost portions, as shown in FIG. 24 which illustrates another embodiment.

As shown in FIG. 23, if all the four wheels 3 are made into castors, since two of these castors can be installed below the rearward projections 111 which are located farthest from the center of gravity, it is possible to increase the starting angle of an overturn toward the rear of the cleaner body, thereby further increasing the stability.

Figure 25:
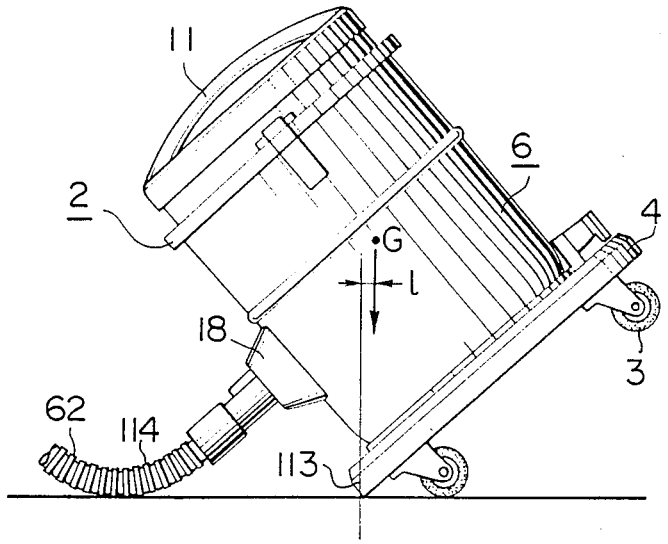
FIG. 25 is a diagram illustrating the safety of the vacuum cleaner body.

FIG. 25 illustrates a case of an overturn toward the front. At a point of time when a front end 113 of the castor base 4 strikes against the floor surface, the position of the center of gravity G of the cleaner body is located at a position offset in the direction of recovering the overturn (in the direction of l). Accordingly, even if an overturning force acts on the cleaner body, the front end 113 of the castor base 4 strikes against the floor surface, thereby making it possible to obviate an overturn.

Even if an overturning force which is greater than that is applied to the cleaner body, since an overturn-preventing force is temporarily provided by the front end 113, the force is dampened before the cleaner body overturns, so that a strong impact is not applied thereto. Consequently, since a floor-contacting portion 114 of the hose 62 does not strongly strike against the floor surface and is not bent strongly, the above-described arrangement exerts little adverse effect on the life of the hose 62.

Figure 26:
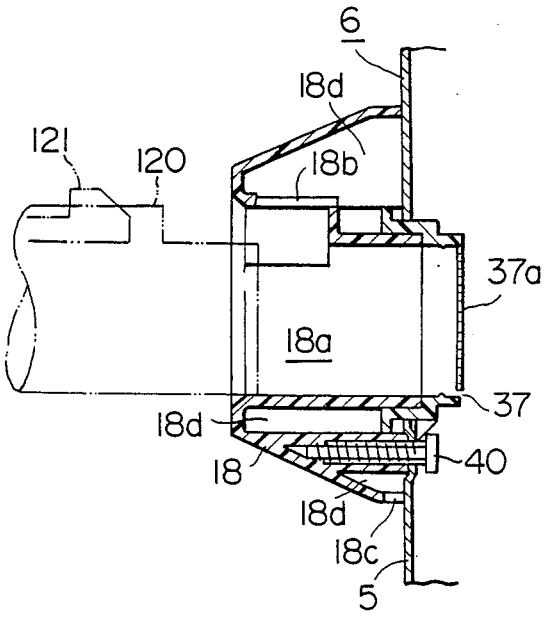
FIG. 26 is a cross-sectional view of an intake port member of a dust case.

A description will now be given of the intake port section of the dust case 6 shown in FIG. 26. An intake port member 18 is secured to the tank 5 by a screw 40 via mouth packing 37. The intake port member 18 is provided with an intake port 18a for inserting a joint 120 into the hose 62 as well as a retaining hole 18b for retaining a stopper 121 for preventing the joint 120 from coming off. If the joint 120 is inserted positively into the intake port 18a, the joint 120 comes into contact with an inner wall portion of the mouth packing 37 to maintain air-tightness. In addition, the mouth packing 37 has a check valve 37a which is integrally formed therewith and is adapted to open and close by an air flow, to ensure that the dust once sucked in will not flow out of the intake port member 18. For this reason, the mouth packing 37 is made of a soft material such as rubber, soft polyvinyl chloride, or the like.

Figure 27:
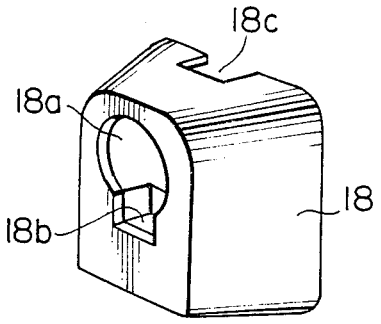
FIG. 27 is a perspective view of the intake port member as viewed from the bottom.
Figure 43:
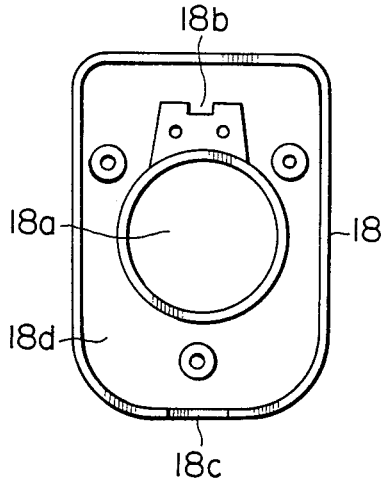
FIG. 43 is a diagram of the intake port member as viewed from the inner surface side thereof.

As described before, the vacuum cleaner in this embodiment not only sucks the dust, but also has the function of a blower which exhausts the exhaust air of the electric blower 1 in a centralized manner. Accordingly, the joint 120 of the hose 62 is removed from the suction port member 18 and is inserted into the blower side to perform an operation, as shown in FIG. 36. In a state in which this joint 120 is not provided, a retaining hole 18 for the stopper 121 is present in an inner wall of the intake port 18a which is an intake passage. For this reason, the interior 18d of the intake port member 18 assumes a negative pressure, with the result that noise is generated due to the pulsation of the air current. As a measure against this problem, the pulsation can be prevented by introducing some air current into the interior 18d by providing a leak hole 18c in an outer periphery of the intake port member 18 which abuts against the tank 5. As for the location of the leak hole 18c, it is provided in a lower portion of the intake port member 18 so as to prevent the influx of the dust and in view of restrictions in design. FIG. 27 is a perspective view of the intake port member 18 as viewed from below, and illustrates the configuration of the the leak hole 18c. FIG. 43 is a diagram of the intake port member 18 as viewed from the inner side.

A description will now be given of the clamp 19 which is mounted on the dust case 6 and used for engagement with the body case.

Figure 28:
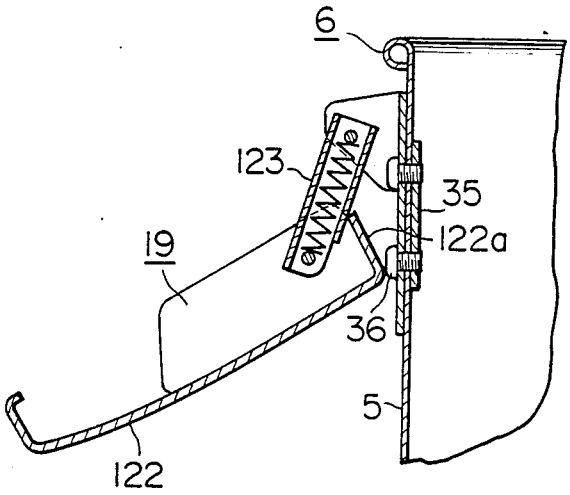
FIG. 28 PRIOR ART
FIG. 28 is a vertical cross-sectional view of a clamp portion of the prior art.
Figure 29:
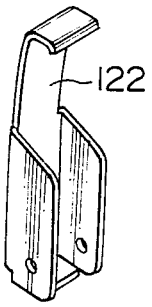
FIG. 29 PRIOR ART
FIG. 29 is a perspective view of a latch of the prior art.
Figure 30:
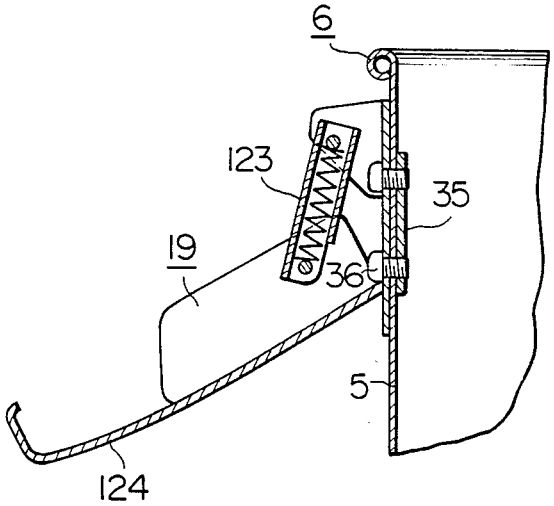
FIG. 30 PRIOR ART
FIG. 30 is a vertical cross-sectional view of another example of the clamp portion of the prior art.

FIGS. 28, 29, and 30 illustrate examples of the prior art, which have had the following drawbacks.

A lower wall 122a of the latch 122 abuts against both a clamp link 123 and a clamp installation screw 36, and the latch 122 is caught in the midway. When the clamp is released, the latch 122 projects substantially to the outside, so that it has been very dangerous. In addition, as shown in FIG. 30, a lower end portion of the latch 124 is caught by a screw head of the clamp installation screw 36, so that there has been a similar drawback.

Figure 31:
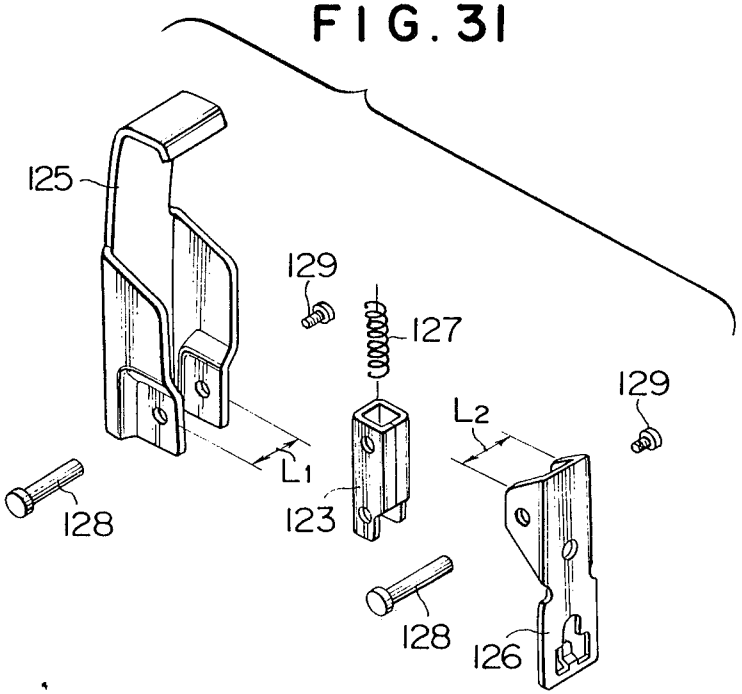
FIG. 31 is a diagram illustrating an arrangement of a clamp in accordance with an embodiment of the present invention.

Main components of the clamp 19 shown in FIG. 31 in accordance with an embodiment of the present invention comprises the following: a latch 125 for hooking on the body case 2, a supporter 126 secured to the tank 5, and the clamp link 123 for coupling with the supporter 126 and adjusting a vertical stroke. Contrivances have been made so that the configuration of the clamp 19 can be made simple to allow standardization and integration of the component parts and improvement of productivity. Specifically, the lengths of two calked pins 128 are made uniform, and a compression coil spring which can be produced at a high level of productivity is used. In addition, to straighten the lateral surfaces of the clamp link 123 and to make its configuration simple to facilitate fabrication, a dimension $L_1$ of the latch 125 and a dimension $L_2$ are made identical. As for calked pins, an arrangement is adopted in which the calked pin 128 and the rivet 129 are pressure-fit to each other by fitting their convex and concave portions, this structure enabling each part to be rotatable and allowing an easy calking operation. In a conventional method of forming a calked pin using one component, it has been necessary to use a special calking method such as spinning calking to improve the finished configuration of the calked portion. In addition, since the calked pin is secured to the latch 125, and this pin is pressed by the spring, the action of the clamp is restricted by friction between the spring and the pin. Accordingly, it has been necessary to adopt a structure in which, instead of the compression spring shown in FIG. 32, a tensile spring is hooked between the supporter 126 and the calked pin. Thus, there have been various problems in productivity.

Figure 32:
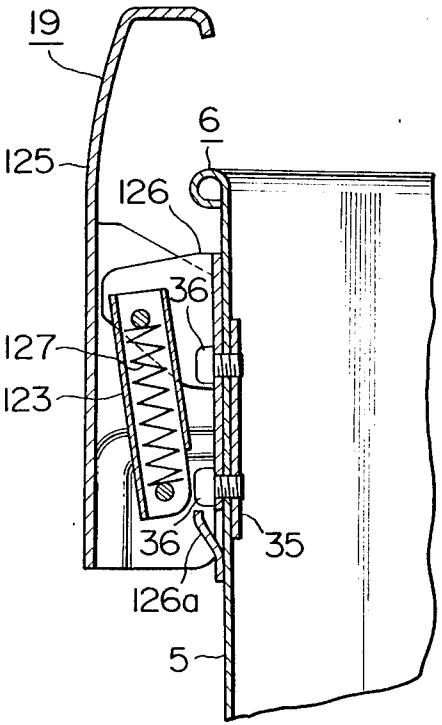
FIG. 32 is a vertical cross-sectional view of a clamp portion in accordance with the embodiment of the present invention.
Figure 34:
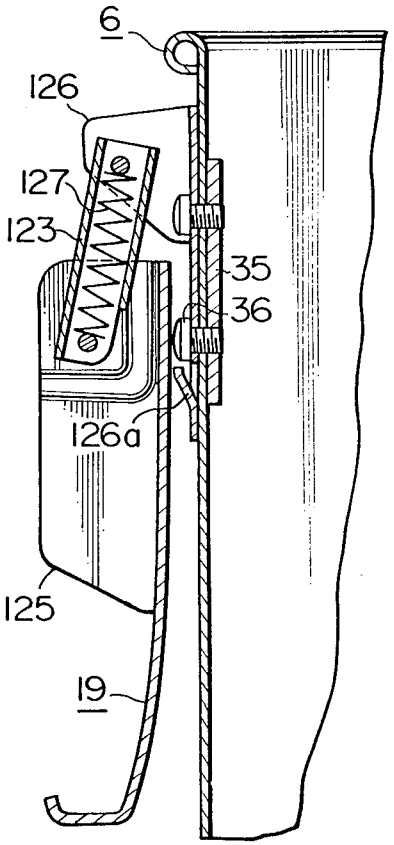
FIGS. 33 and 34 are vertical cross-sectional views illustrating the operation of the clamp.
Figure 33:
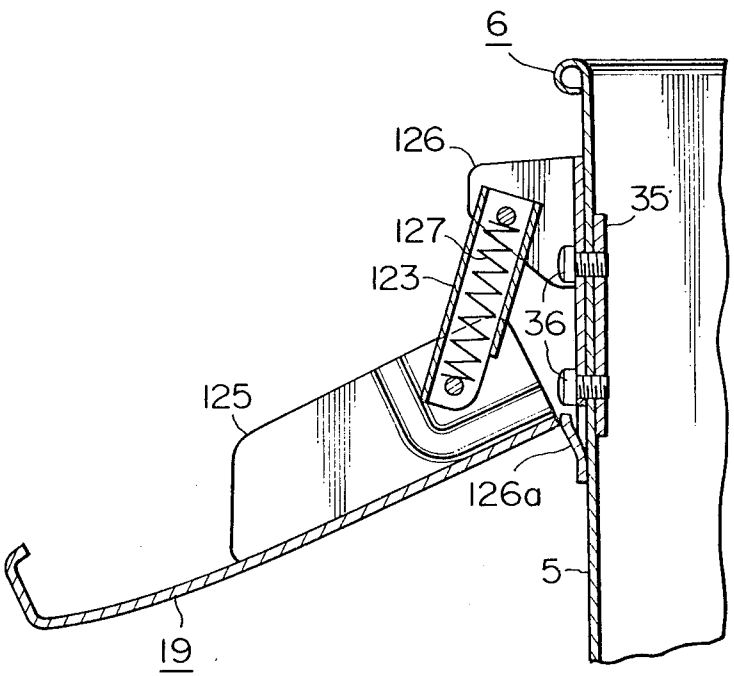

FIG. 32 is a cross-sectional view of the clamp section, while FIGS. 33 and 34 illustrate the operation of an improved clamp section designed to overcome the problem of catching of the aforementioned latch 124, shown in FIG. 30, by the clamp installation screw 36. An arrangement is provided such that an overriding cut-out 126*a* which serves as a guide is provided in the supporter 126 to ensure that an end portion of the latch 125 will not be caught by the head of the screw 36. Consequently, the latch 125 is not caught in the midway and can therefore be pulled down completely.

Referring now to FIG. 35, a description will be given of the exhaust passages provided in the body case.

The motor base 9 has partition walls 9*a* inside it, and the electric blower 1 is accommodated on the inner side of the partition walls 9*a*. Similarly, the upper case 10 is also provided with partition walls (not shown) inside it, and partition walls 9*a* of the motor base 9 and those of the upper case 10 abut against each other. The exhaust air flows from an inlet port 26*a* of a blower body 26 and an opening 9*b* provided in the motor base 9 into a flow passage changeover chamber 130 defined by the blower body 26 and the motor base 9. A blower cover 27, which is inserted into a fan-shaped hole 51 in an upper portion of the blower body 26, is slidable to make it possible to change over the exhaust system by a single operation between the centralized exhaust from the blower and the decentralized exhaust from the outer periphery of the body case 2 as a shielding plate 27*a* is moved. Specifically, if the blower cover 27 is moved in the direction of the arrow A, the exhaust system assumes the state of decentralized exhaust, while, if, conversely, it is moved in the direction of the arrow B, the exhaust system assumes the state of centralized exhaust. The blower cover 27 is so arranged to serve as both a member for changing over the exhaust system and a cover for a centralized exhaust port 26*b*, by taking into consideration such factors as a reduction in the number of parts used and improvement of productivity.

Also, the partition wall 9*a* is provided with a partial notch 9*e*, in addition to the inlet port 26*a* and the opening 9*b*, to prevent the centralization of the exhaust air so as to reduce the noise of the air.

Figure 45:
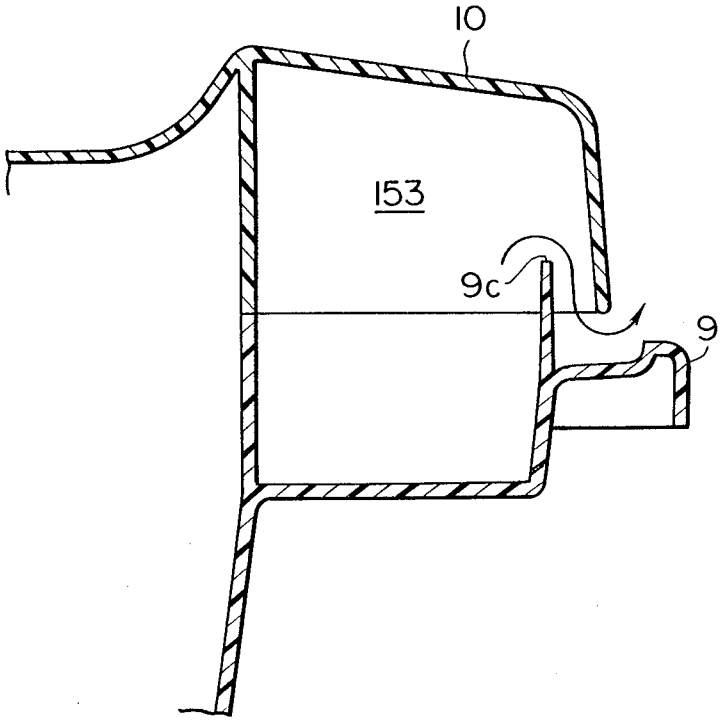
FIG. 45 is a cross-sectional view illustrating a state of exhaust from the body case at a position remote from the decentralized exhaust port.
Figure 44:
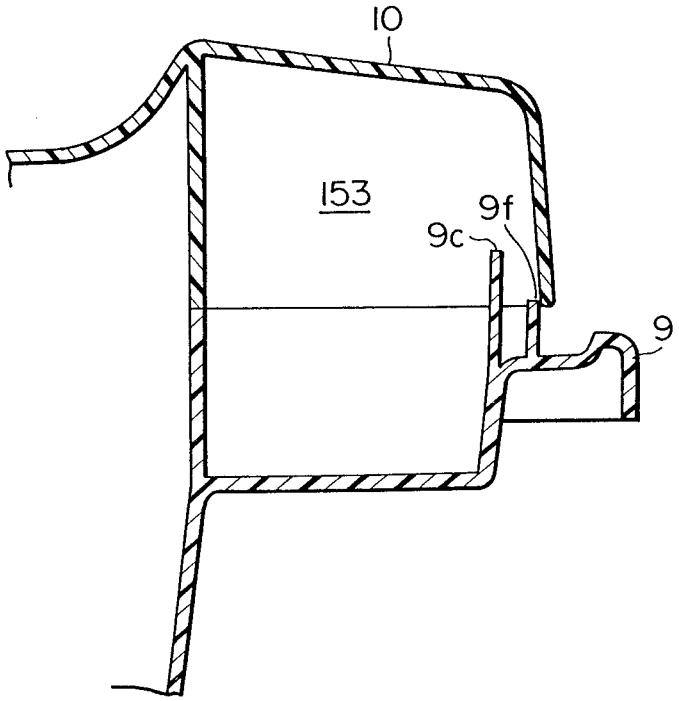
FIG. 44 is a cross-sectional view illustrating an exhaust channel constituted by the upper case and a motor base in the vicinity of a decentralized exhaust port.

In the case of decentralized exhaust, an exhaust passage 153 is formed in which the air flows in one direction from a decentralized exhaust port 131 along the outer peripheries of the partition walls 9*a*. A rib 9*f* is provided in the vicinity of the decentralized exhaust port 131 so as to provide a hermetically sealed structure, as shown in FIG. 44, and a shielding wall 9*c* is formed such as to be superposed on the inner side of the rib 9*f*. Hence, the sound shielding effect is enhanced. In addition, the exhaust passage 153 is arranged to allow the air to flow only in one direction, and is exhausted from the body case 2 to the outside by overriding the shielding wall 9*c* at a position remote from the decentralized exhaust port 131 in the directions of the arrows C, D and E shown in FIG. 35. The shielding wall 9*c* is a multi-purpose wall designed to shield the noise, reduce the velocity of the exhaust air, and provide electrical protection of the internal electrical components. This shielding wall 9*c* has a higher wall as compared with the height of the side of the upper case 10 and is arranged to be lapped, as shown in the cross-sectional view in FIG. 45, so that the air flow is exhausted in a meandering manner.

In addition, since the exhaust air which has cooled the electric blower is in a high-temperature state, such electrical components as the body socket 15, the power switch 16, and the power brush socket outlet 17 are located at positions remote from the decentralized exhaust port 131 so that these electrical components are disposed downstream of the decentralized exhaust current, as shown by the arrow, so as to reduce the temperature of the exhaust air, thereby preventing the effect of the high-temperature exhaust air from being exerted on such electrical components. Furthermore, a bypass valve which operates when the filter becomes abnormally loaded is provided at a position remote from the decentralized exhaust port 131, and a double-structure wall is provided around the bypass valve to prevent the reduction of the exhaust air.

Reference numeral 9*d* denotes a hole which serves as a bypass valve cylinder, into which a bypass spring 132, a bypass piston 133, and bypass packing 134 are inserted to constitute a bypass valve.

FIG. 36 is a diagram illustrating the operation of the blower. The blower can be used if the blower cover 27 is opened, and the joint 120 of the hose 62 is inserted into the centralized exhaust port 26*b*.

The indicator 13 is accommodated in a recess 57 provided in the upper case 10, as shown in FIG. 37. The indicator 13 is adapted to introduce the negative pressure downstream of the filter (in both cases of the cloth filter and the paper bag filter) inside the tank 5 into a communicating passage, which will be described below, and a piston of the indicator 13 constituted by a casing, a piston, and a compression coil spring (none of them are shown), thereby indicating a state of loading of the filter section through an amount of movement of the piston corresponding to the negative pressure.

The aforementioned communicating passage is arranged as follows: A bush 140 fitted to the intake side of the indicator 13, a communicating pipe 141 provided integrally on the upper case 10, and a communicating pipe 142 provided integrally on the motor base 9 are respectively fitted in such a manner as to form a single communicating passage. The communicating pipe 142 is open inside the tank 5. As shown in the perspective view of FIG. 37, the communicating pasage can be automatically formed by simply combining and assembling together the motor base 9 nd the upper case 10 without using any special components.

The indicator cover 25 has a plurality of claws 143, which are inserted into corresponding holes 144 provided in a recess 57 in the upper case 10 to allow projections 145 respectively provided at the tips of the claws 143 to engage therewith.

Since the indicator cover 25 is retained by the resiliency of the claws 143, the indicator cover 25 can be removed readily by cancelling the retention of the claws 143 by using a screwdriver or the like.

During repair of the indicator 13, there is no need to disassemble the body case 1, and an operation of such as replacement of the indicator 13 can be effected from the outside, with the result that the servicing efficiency can be improved remarkably.

Referring to FIGS. 38, 39, 40, and 41, a description will be made of the structure of installing the handle 11 provided on the upper portion of the upper case 10.

Stepped-down handle-fitting portions 10*a*, 10*b* are respectively provided on the upper surface of the upper case 10 on the front and rear sides thereof. A retaining recess 10*c* for engaging with a retaining portion 11*a* of the handle 11 is provided on a side surface of the handle-fitting portion 10*a* on the front side. Accordingly, the handle 11 can be fitted from the forward direction of the upper case 10 in such a manner that the retaining portion 11*a* is engaged positively with the retaining recess 10*c*. A rear portion 11*b* of the handle 11 is then fitted into the handle fitting portion 10*b* of the upper case 10, and a screw 135 is tightened, thereby securing the handle 11. A front portion 11*c* and the rear portion 11*b* of the handle 11 are thus respectively engaged with the handle-fitting portions 10*a*, 10*b* of the upper case 10. The arrangement is such that when a transverse force is applied to the handle 11, inner peripheral ribs 11*e*, 11*f* abut against ribs 10*f*, 10*g* provided integrally on the upper case 10, so that a sufficient strength can be obtained with a single screw.

In addition, as the system of connecting the power cord, an arrangement is provided in another embodiment to realize a structure in which a power cord 136 is connected directly to the body case 2, instead of using the power cord 136. A bush 137 is fitted around the power cord 136, and a grooved portion 137*a* of the bush 137 is fitted into a through hole constituted by a cord insertion groove 11*d* of the handle 11 and a cord insertion groove 10*d* of the upper case 10. The power cord 136 is secured by a cord holder 138 and a cord retaining portion 10*e* by means of a screw 139. A terminal 137*b* of the power cord is connected to an internal wiring terminal 154 provided in the handle inserting portion 10*b* of the upper case 10. Thus, by adoption of an arrangement in which the power cord 136 is pulled out from a junction between the upper case 10 and the handle 11, an attempt is made to reduce the number of parts used, enhance the assembling efficiency, and facilitate the replacement and maintenance of the power cord 136.

Figure 3:
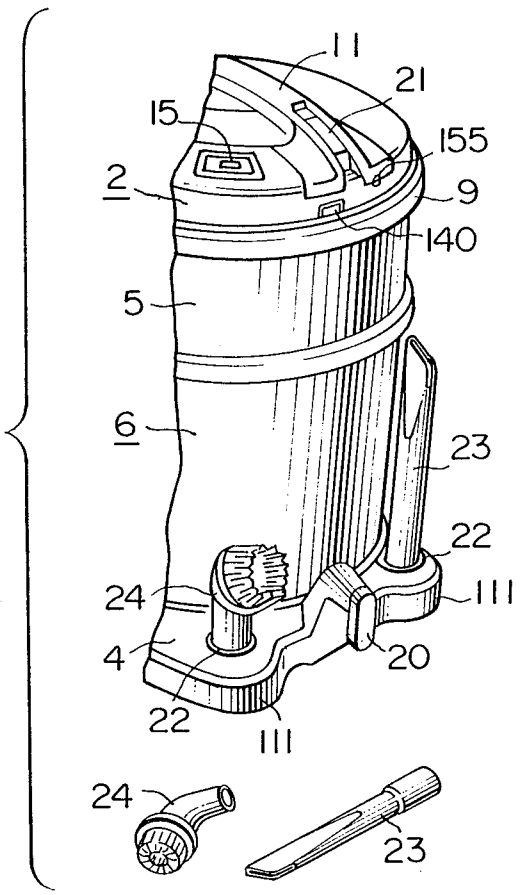
FIG. 3 is a perspective view of the rear side thereof.
Figure 2:
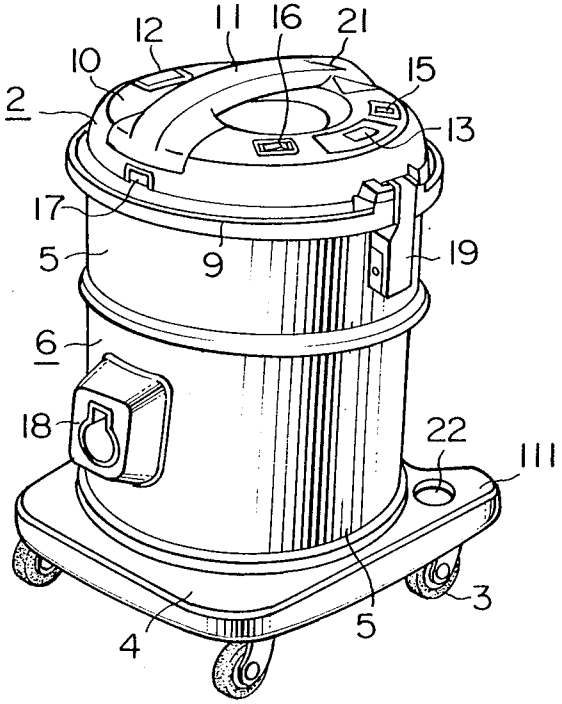
FIG. 2 is a perspective view of the front side thereof.

In addition, since a power changeover switch 140, which is provided on a model that can be used with respect to two types of supply voltage, is provided on an outer cover portion of the upper case 10 in the vicinity of the cord insertion groove 10*d* through which the power cord 136 is installed on the body case 2 or in the vicinity of the body socket 15 and the upper cord hook 21 for holding and accommodating the power cord 136, it is possible to confirm the set voltage of the power changeover switch 140 each time the power cord 14 is inserted or is used after being removed from the upper cord hook 21. In consequence, it is possible to prevent in advance such trouble as the burning of the electric motor 1 due to the erroneous setting of the set voltage. Incidentally, since the arrangement is such that both the power cord-directly-connected system according to the embodiment shown in FIG. 41 and the system using the body socket according to another embodiment can be selectively realized, in the case of the body socket system, the cord insertion grooves 10*d*, 11*d* are blocked by a block plate 155, as shown in FIGS. 3 and 4.

Figure 42:
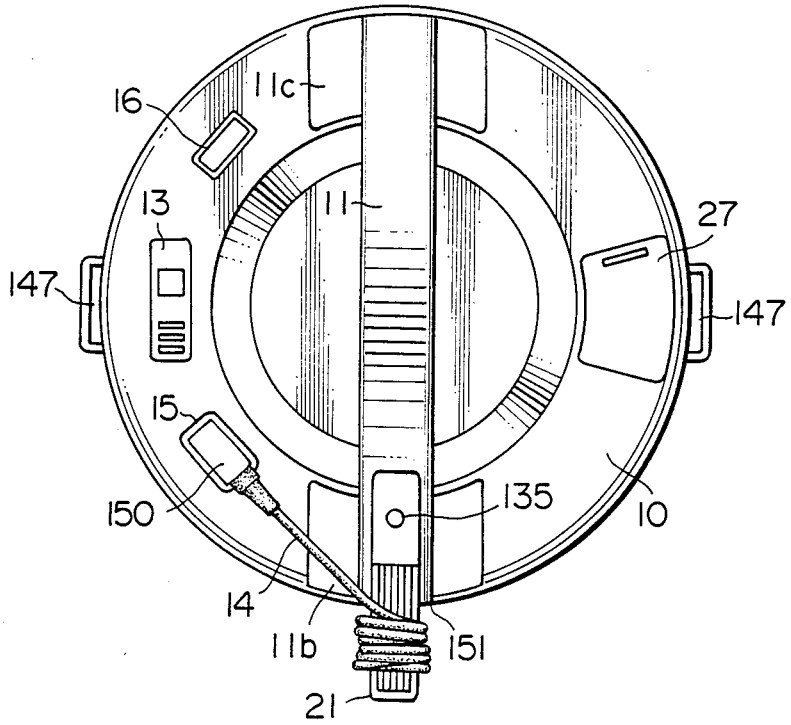
FIG. 42 is a top plan view of the body case.

As shown in FIG. 42, the body socket 15 is disposed in such a manner that, at the time when a connector 150 is connected to the body socket 15, and the power cord 14 is wound around the upper and lower cord hooks 21, 22 for accommodation, the orientation of the power cord 14 being taken up and the orientation of the connector 150 form a substantially straight line without the power cord 14 becoming damaged by being forcefully bent or twisted abruptly at the root of the connector 150. Namely, the body socket 15 is installed in a direction substantially parallel with the outer periphery of the upper case 10. At this time, if a position 151 at which the power cord 14 is wound around the upper cord hook 21 is offset, the aforementioned state of a straight line cannot be maintained. Therefore, the inner side of the upper cord hook 21 is made into a curved configuration 152 at a relatively sharp angle, thereby to fix the position at which the power cord 14 is wound. In this embodiment, although the body case and the dust case are made as separate units, the present invention is not restricted to this arrangement, and the present invention is applicable to a structure in which the two cases are formed integrally.

As has been described above, in accordance with the present invention, since static electricity produced can be removed through a corona discharge, it is possible to provide a vacuum cleaner which excels in the handling efficiency, reliability, and safety.

What is claimed is:

1. An electric vacuum cleaner comprising:

a body case;

an electric blower including a motor housing and provided in said body case;

means for causing corona discharge including two conductive members provided in said body case for discharging static electricity from one of said conductive members to the other of said conductive members, said one of said conductive members being electrically connected to said motor housing of said electric blower and said other of said conductive members being electrically connected to a portion of said electric vacuum cleaner where static electricity occurs, wherein said other of said conductive members is a felt member made of acrylonitrile-copper sulfate composite fibers.

2. An electric vacuum cleaner according to claim 1, wherein said other of said conductive members is electrically connected to said body case.

3. An electric vacuum cleaner comprising:

a body case;

an electric blower including a motor housing and provided in said body case;

means for causing corona discharge including two conductive members provided in said body case for discharging static electricity from one of said conductive members to the other of said conductive members, said one of said conductive members being electrically connected to said motor housing of said electric blower and said other of said conductive members being electrically connected to a portion of said electric vacuum cleaner where static electricity occurs, wherein said one of said conductive members which is electricity connected to said motor housing is a pressure washer and said other of said conductive members is a felt member made of acrylonitrile-copper sulfate composite fibers.

4. An electric vacuum cleaner according to claim 3, wherein said other of said conductive members is electrically connected to said body case.

* * * * *